US005553339A

United States Patent [19]

Thomas

[11] Patent Number: 5,553,339

[45] Date of Patent: Sep. 10, 1996

[54] ADJUSTABLE AIR MATTRESS SLEEPING BAG

[76] Inventor: Roy C. Thomas, 11735 S. Glen #168, Houston, Tex. 77099

[21] Appl. No.: 393,656

[22] Filed: Feb. 24, 1995

[51] Int. Cl.[6] ..... A47G 9/08

[52] U.S. Cl. ..... 5/413 AM; 5/710

[58] Field of Search ..... 5/413, 455, 449, 5/420; 2/69.5

[56] References Cited

U.S. PATENT DOCUMENTS

| | | | |
|---|---|---|---|
| 779,576 | 1/1905 | Berryman | 5/455 |
| 867,464 | 10/1907 | Abbott | 5/413 |
| 1,324,009 | 12/1919 | Hope | 5/413 |
| 1,648,373 | 11/1927 | Vilas | 5/413 |
| 2,691,179 | 10/1954 | Kann | 5/455 |
| 4,862,533 | 9/1989 | Adams, III | 5/413 |
| 4,996,733 | 3/1991 | Tsai | 5/413 |

FOREIGN PATENT DOCUMENTS

| | | | |
|---|---|---|---|
| 207621 | 11/1939 | Switzerland | 5/413 |

*Primary Examiner*—Alexander Grosz

[57] ABSTRACT

A sleeping bag for supporting and insulating an individual during sleep. The inventive device includes a sleeping bag having a pneumatic support assembly for supporting the sleeping bag in a spaced relationship relative to a ground surface. The pneumatic support assembly includes a plurality of elongated flexible air tubes which can be individually pressurized to a desired pneumatic pressure to support the sleeping bag at a desired height and firmness.

3 Claims, 4 Drawing Sheets

FIG. 5
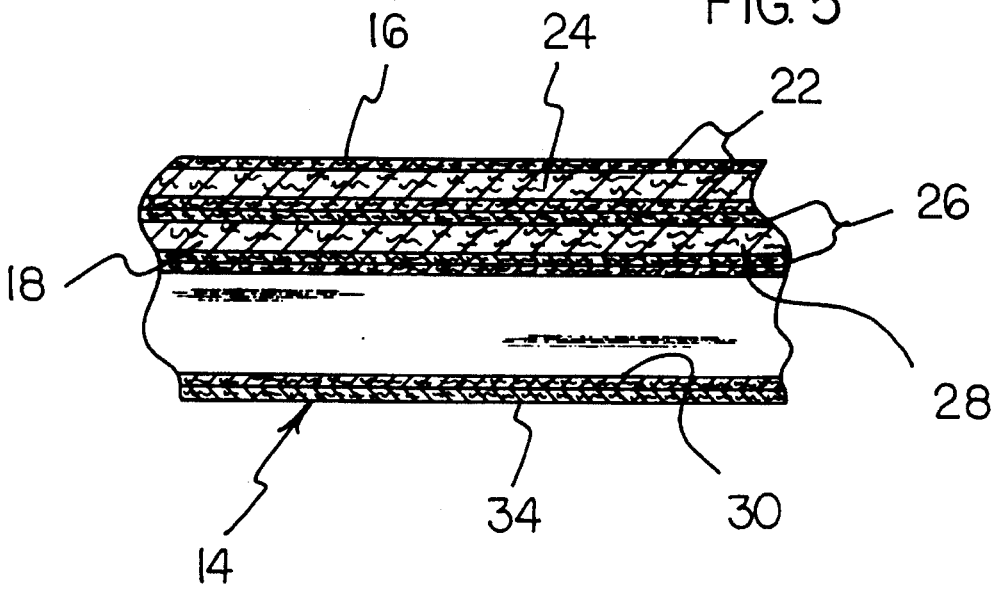
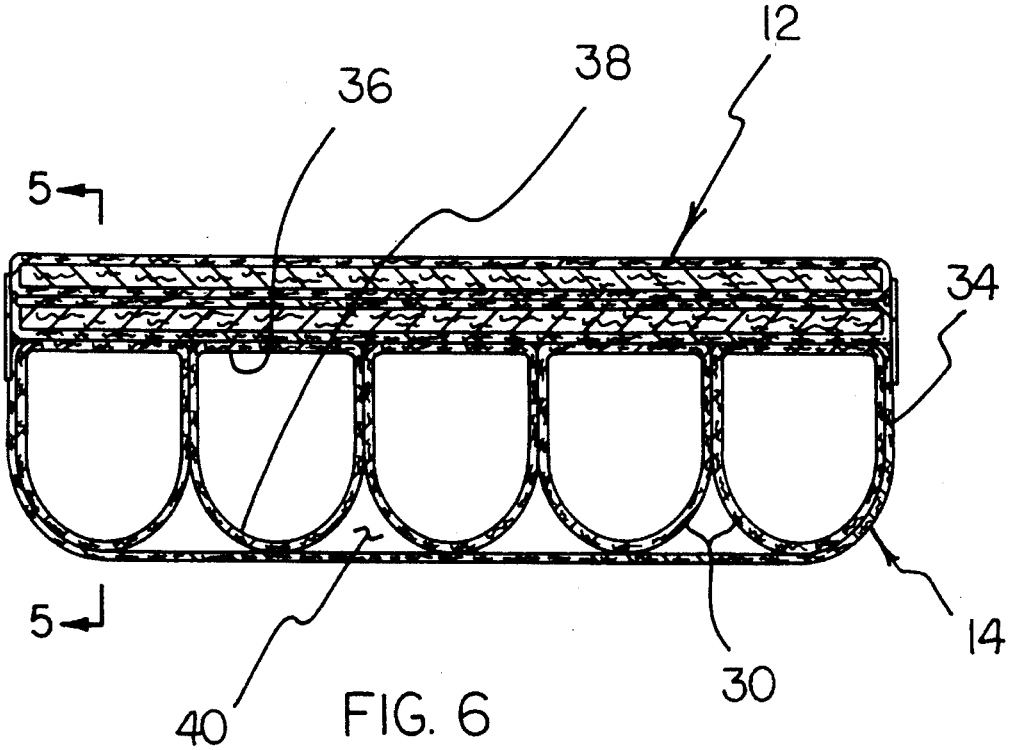
FIG. 6

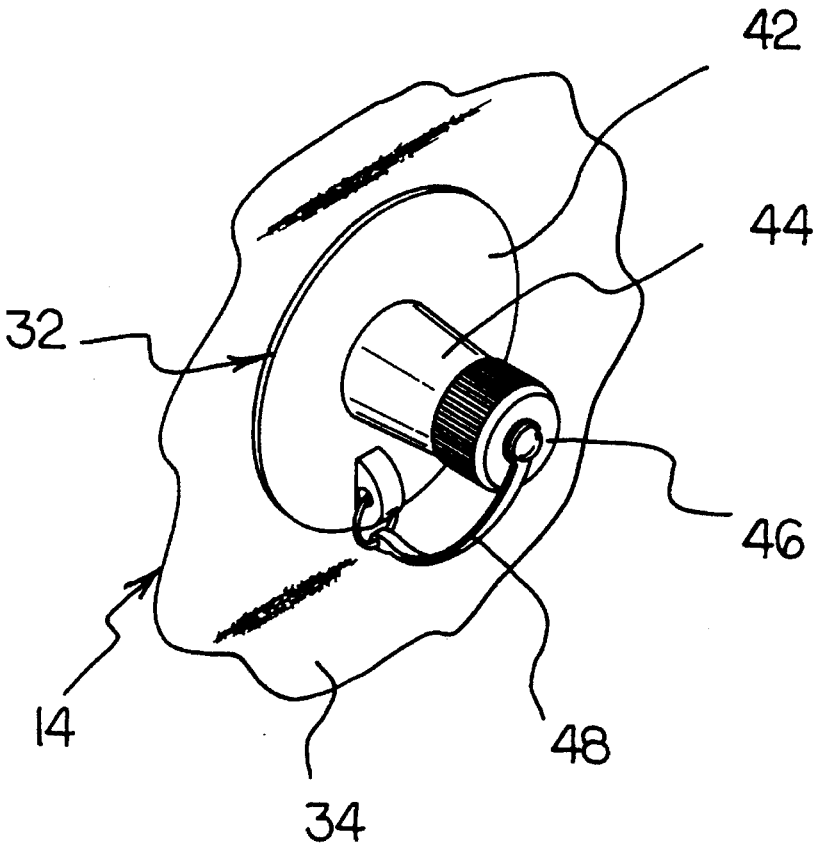
FIG. 7
FIG. 8
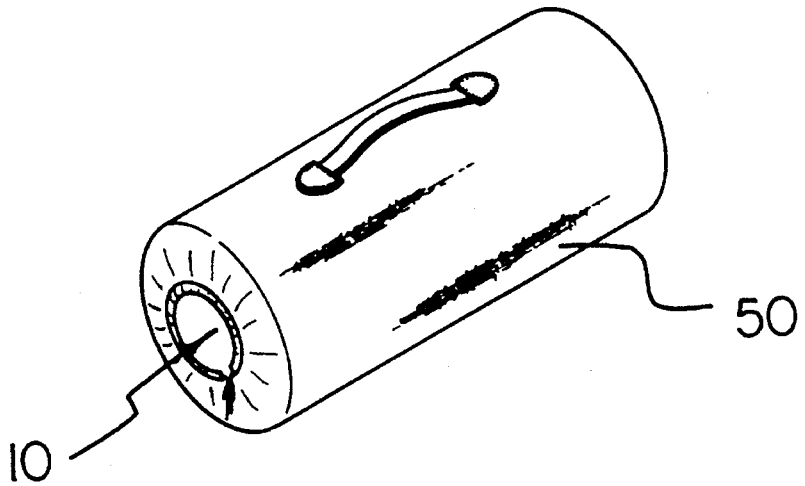

ADJUSTABLE AIR MATTRESS SLEEPING BAG

BACKGROUND OF THE INVENTION

1. Field of the Invention

The present invention relates to bedding devices and more particularly pertains to an adjustable air mattress sleeping bag for supporting and insulating an individual during sleep.

2. Description of the Prior Art

The use of bedding devices is known in the prior art. More specifically, bedding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bedding devices include U.S. Pat. No. 4,996,733; U.S. Pat. No. 4,894,878; U.S. Pat. No. 4,091,482; U.S. Pat. No. 3,877,092; and U.S. Pat. No. 3,798,686.

While these devices fulfill their respective, particular objectives and requirements, the aforementioned patents do not disclose an adjustable air mattress sleeping bag for supporting and insulating an individual during sleep which includes a sleeping bag having a pneumatic support assembly for supporting the sleeping bag in a spaced relationship relative to a ground surface, wherein the pneumatic support assembly includes a plurality of elongated flexible air tubes which can be individually pressurized to a desired pneumatic pressure to support the sleeping bag at a desired height and firmness.

In these respects, the adjustable air mattress sleeping bag according to the present invention substantially departs from the conventional concepts and designs of the prior art, and in so doing provides an apparatus primarily developed for the purpose of supporting and insulating an individual during sleep.

SUMMARY OF THE INVENTION

In view of the foregoing disadvantages inherent in the known types of bedding devices now present in the prior art, the present invention provides a new adjustable air mattress sleeping bag construction wherein the same can be utilized for supporting and insulating an individual during sleep. As such, the general purpose of the present invention, which will be described subsequently in greater detail, is to provide a new adjustable air mattress sleeping bag apparatus and method which has many of the advantages of the bedding devices mentioned heretofore and many novel features that result in an adjustable air mattress sleeping bag which is not anticipated, rendered obvious, suggested, or even implied by any of the prior art bedding devices, either alone or in any combination thereof.

To attain this, the present invention generally comprises a sleeping bag for supporting and insulating an individual during sleep. The inventive device includes a sleeping bag having a pneumatic support assembly for supporting the sleeping bag in a spaced relationship relative to a ground surface. The pneumatic support assembly includes a plurality of elongated flexible air tubes which can be individually pressurized to a desired pneumatic pressure to support the sleeping bag at a desired height and firmness.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable air mattress sleeping bag apparatus and method which has many of the advantages of the bedding devices mentioned heretofore and many novel features that result in an adjustable air mattress sleeping bag which is not anticipated, rendered obvious, suggested, or even implied by any of the prior art bedding devices, either alone or in any combination thereof.

It is another object of the present invention to provide a new adjustable air mattress sleeping bag which may be easily and efficiently manufactured and marketed.

It is a further object of the present invention to provide a new adjustable air mattress sleeping bag which is of a durable and reliable construction.

An even further object of the present invention is to provide a new adjustable air mattress sleeping bag which is susceptible of a low cost of manufacture with regard to both materials and labor, and which accordingly is then susceptible of low prices of sale to the consuming public, thereby making such adjustable air mattress sleeping bags economically available to the buying public.

Still yet another object of the present invention is to provide a new adjustable air mattress sleeping bag which provides in the apparatuses and methods of the prior art some of the advantages thereof, while simultaneously overcoming some of the disadvantages normally associated therewith.

Still another object of the present invention is to provide a new adjustable air mattress sleeping bag for supporting and insulating an individual during sleep.

Yet another object of the present invention is to provide a new adjustable air mattress sleeping bag which includes a sleeping bag having a pneumatic support assembly for supporting the sleeping bag in a spaced relationship relative to a ground surface, wherein the pneumatic support assembly includes a plurality of elongated flexible air tubes which can be individually pressurized to a desired pneumatic pressure to support the sleeping bag at a desired height and firmness.

Even still another object of the present invention is to provide a new adjustable air mattress sleeping bag wherein the pneumatic support assembly includes a plurality of elongated flexible air tubes which can be individually pressurized to a desired pneumatic pressure to support the sleeping bag at a desired height and firmness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of a portion of the present invention taken along a longitudinal length thereof.

FIG. 6 is a cross-sectional view taken along line 6—6 of FIG. 3.

FIG. 7 is an isometric illustration of a valve means of the invention.

FIG. 8 is an isometric illustration of the present invention stored within a cylindrical storage bag.

DESCRIPTION OF THE PREFERRED EMBODIMENT

Figure 1:
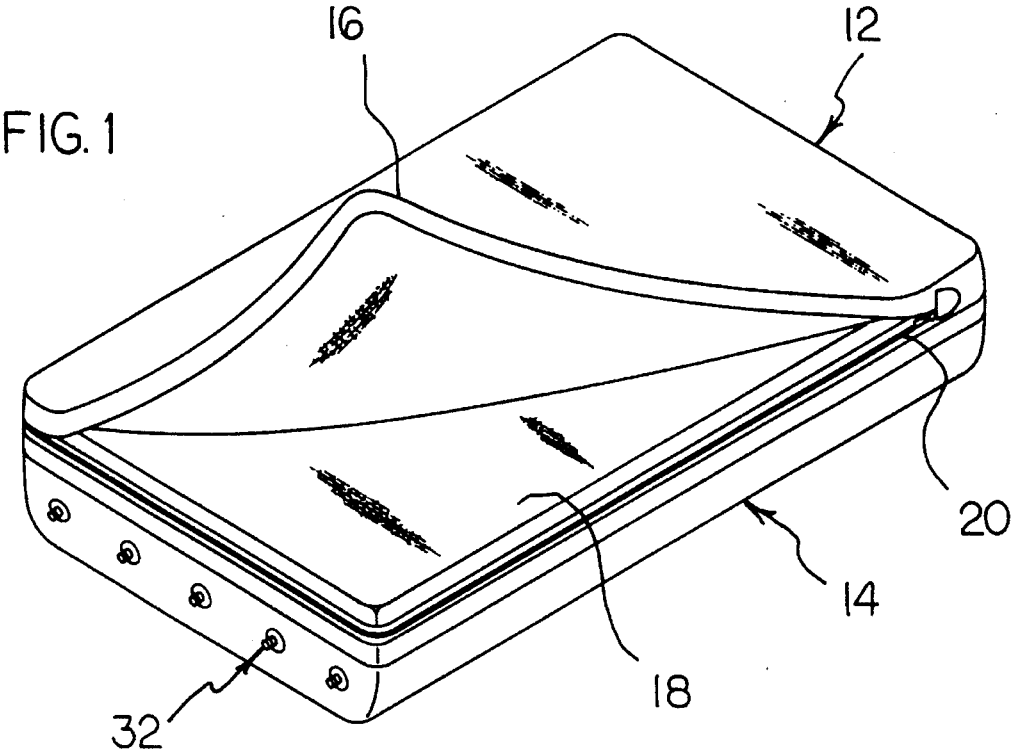
FIG. 1 is an isometric illustration of an adjustable air mattress sleeping bag according to the present invention.
Figure 2:
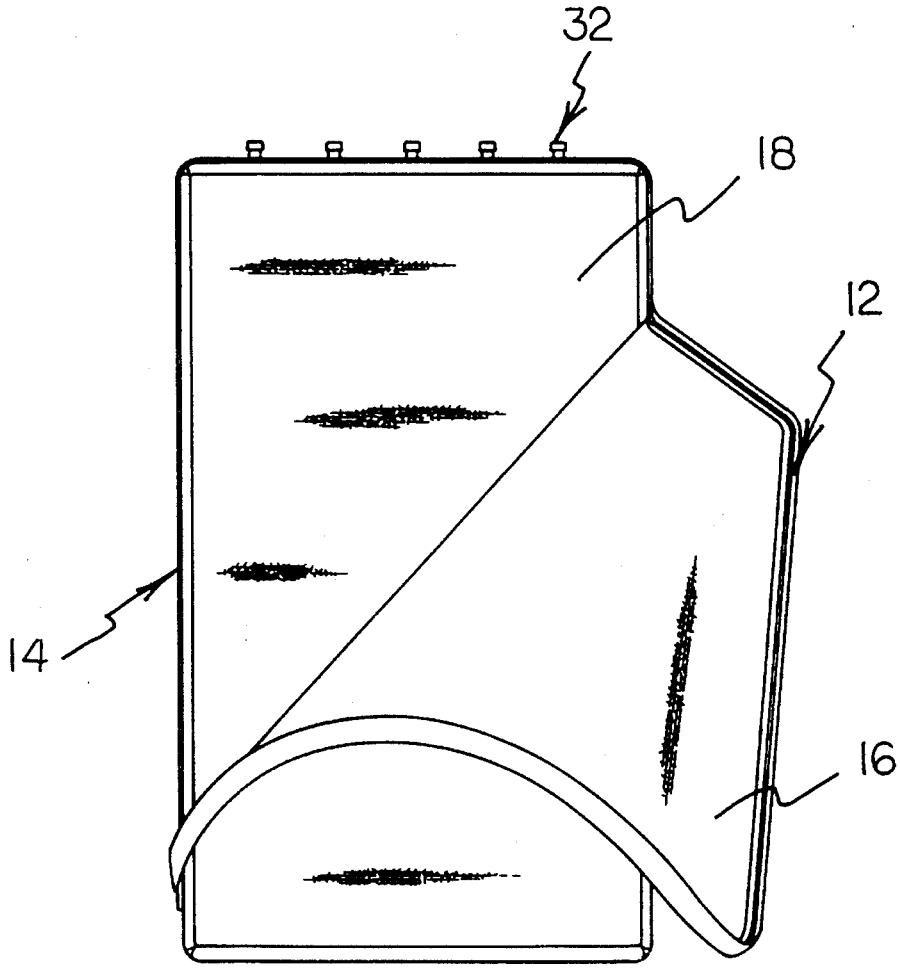
FIG. 2 is a top plan view of the invention.
Figure 3:
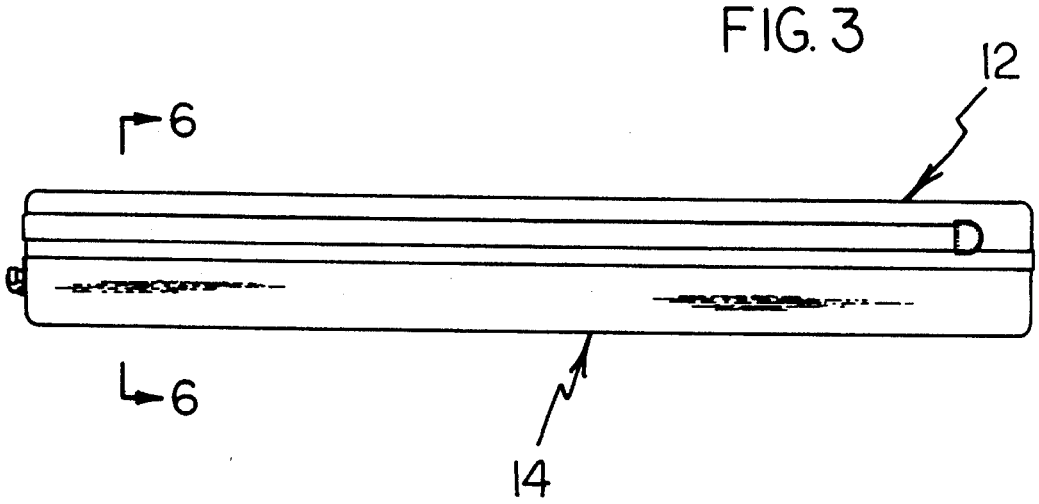
FIG. 3 is a side elevation view thereof.
Figure 4:
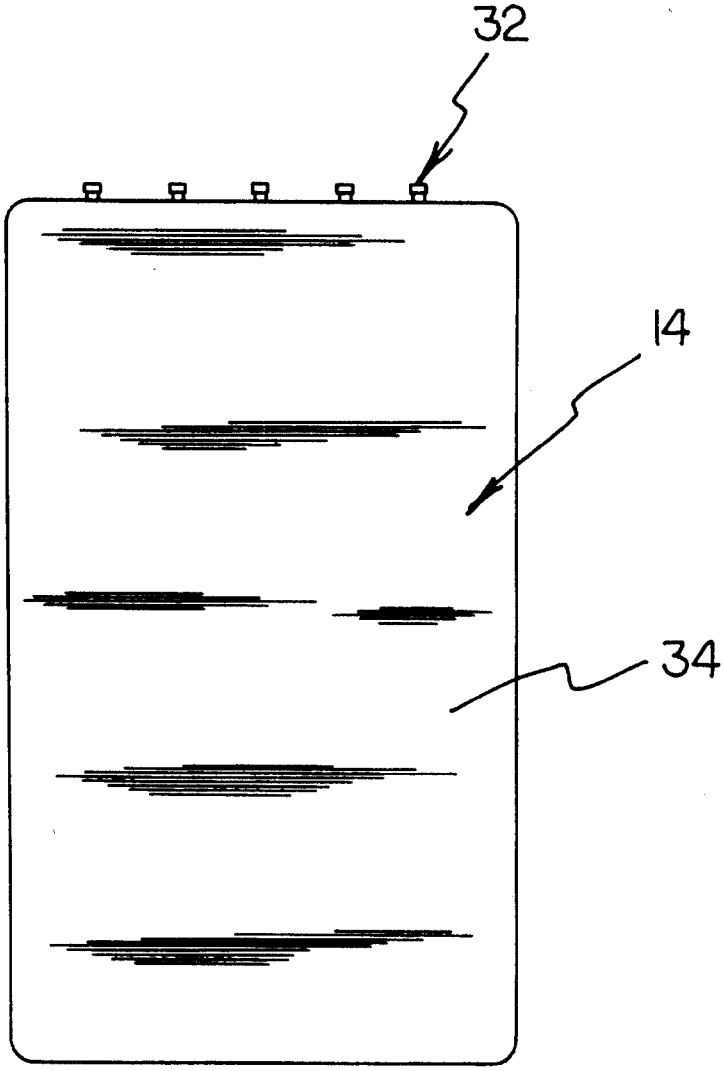
FIG. 4 is a bottom plan view of the air mattress sleeping bag.

With reference now to the drawings, and in particular to FIGS. 1–8 thereof, a new adjustable air mattress sleeping bag embodying the principles and concepts of the present invention and generally designated by the reference numeral 10 will be described.

More specifically, it will be noted that the adjustable air mattress sleeping bag 10 comprises a sleeping bag means 12 for receiving and insulating an individual during sleep. A pneumatic support means 14 is coupled to a lower surface of the sleeping bag means 12 for supporting the sleeping bag means in a spaced relationship relative to an unillustrated ground surface. By this structure, the adjustable air mattress sleeping bag 10 can be utilized to comfortably support and insulate an individual during sleep upon rough or rugged terrain.

As best illustrated in FIGS. 1 through 5, it can be shown that the sleeping bag means 12 according to the present invention comprises an unlabelled sleeping bag including an upper composite web 16 coupled to a lower composite web 18. A zipper 20 extends between peripheries of the upper and lower composite webs 16 and 18 to removably couple the webs together, whereby an individual can reside between the upper and lower composite webs 16 and 18 during sleep. As shown in FIG. 5, the upper composite web 16 is comprised of a pair of spaced upper fabric webs 22 having upper insulation 24 residing between the upper fabric webs. Similarly, the lower composite web 18 comprises a pair of spaced lower fabric webs 26 having lower insulation 28 positioned therebetween. By this structure, an individual residing between the upper and lower composite webs 16 and 18 is substantially protected and insulated from an exterior of the sleeping bag means 12. Preferably, the fabric webs 22 and 26 comprise a water resistant fabric, such as nylon mesh or the like, which serve to preclude an individual from getting wet during a rain storm or the like when the device 10 is utilized in the outdoors.

As shown in FIGS. 3 through 6, the pneumatic support means 14 according to the present invention 10 comprises a plurality of elongated air tubes 30 coupled to a lower surface of the lower composite web 18 of the sleeping bag means 12 which are oriented so as to extend substantially parallel to a longitudinal length of the sleeping bag means. Each of the air tubes 30 is positioned in communication with a plurality of valve means 32 (see FIGS. 1 and 2) for facilitating ingress and egress of air relative to an interior of the air tubes. By this structure, each of the air tubes 30 can be selectively inflated or deflated to support the sleeping bag means 12 at a desired height and firmness relative to the unillustrated ground surface upon which the device 10 is positioned during use thereof. An exterior covering 34 is coupled to the sleeping bag means 12 and extends across and around the air tubes 30 so as to encapsulate the same. Preferably, the air tubes 30 are each shaped so as to define an elongated planar portion 36 positioned flatly against the lower surface of the lower composite web 18 of the sleeping bag means 12, and a U-shaped channel portion 38 integrally coupled to the elongated planar portion 36 to define the closed air tube 30. The U-shaped channel portion 38, because of its exterior shape relative to the exterior covering 34, defines a plurality of compression spaces 40 which can be resiliently deformed to substantially conform to the topography of rough or rugged terrain. Further, because the air tubes 30 are each provided with their own individual valve means 32, the pneumatic support means 14 can be selectively adjusted to position the sleeping bag means 12 in a level orientation along a ground surface which is angled relative to a transverse dimension thereof.

As best illustrated in FIG. 7, the valve means 32 according to the present invention 10 preferably comprises a substantially circular mounting flange 42 which is secured to an exterior surface of the exterior cover 34 by an adhesive or other similar fastening means. A hollow projection 44 extends from the mounting flange 42 and is positioned into fluid communication with an individual one of the air tubes 30. The hollow projection 44 includes exterior threads to which a removable cap 46 is threadably engaged to selectively permit or preclude fluid communication through the hollow projection 44. A tether 48 is coupled to the mounting flange 42 and extends outwardly therefrom to rotatably couple with the removable cap 46 so as to preclude a loss of the removable cap when unattached relative to the hollow projection 44. By this structure, the removable cap 46 can be selectively decoupled from the hollow projection 44, whereby a suitable air pressure source can be fluidly coupled to the hollow projection to effect injection of pressurized air into the associated air tube 30. Preferably, an individual may simply exhale through the hollow projection 44 and into the air tube 30 to effect inflation thereof.

As shown in FIG. 8, the present invention 10 may further comprise a cylindrical storage bag 50 within which the sleeping bag means 12 and the uninflated pneumatic support means 14 can be rolled and positioned for storage and/or transportation thereof.

In use, the adjustable air mattress sleeping bag 10 according to the present invention can be easily utilized to support an individual in an insulated and spaced orientation relative to a ground surface. The pneumatic support means 14 can be selectively inflated as desired to position the sleeping bag means 12 at a desired height and firmness relative to a ground surface therebeneath. The pneumatic support means 14 substantially conforms to the topography of rough or uneven terrain to provide a comfortable and substantially level orientation of the individual utilizing the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable air mattress sleeping bag comprising:

a sleeping bag means for receiving and insulating an individual;

a pneumatic support means coupled to a lower surface of the sleeping bag means for supporting the sleeping bag means in a spaced relationship relative to a ground surface, wherein the sleeping bag means comprises a sleeping bag including an upper composite web; a lower composite web coupled to the upper composite web; and a zipper extending between peripheries of the upper and lower composite webs to removably couple the webs together, wherein the upper composite web comprises a pair of spaced upper fabric webs having upper insulation residing between the upper fabric webs, and the lower composite web comprises a pair of spaced lower fabric webs having lower insulation positioned therebetween, wherein the pneumatic support means comprises a plurality of elongated air tubes coupled to a lower surface of the lower composite web of the sleeping bag means which are oriented so as to extend substantially parallel to a longitudinal length of the sleeping bag means, wherein each of the air tubes is positioned in communication with one of a plurality of valve means for facilitating ingress and egress of air relative an interior of the air tubes such that each of the air tubes can be selectively and individually inflated and deflated, wherein the pneumatic support means further comprises an exterior covering coupled to the sleeping bag means and extending across and around the air tubes so as to encapsulate the air tubes, wherein the air tubes are each shaped so as to define an elongated planar portion positioned flatly against the lower surface of the lower composite web of the sleeping bag means; and a U-shaped channel portion coupled to the elongated planar portion, wherein the U-shaped channel portions of the air tubes cooperate to define a plurality of compression spaces between the air tubes.

2. The adjustable air mattress sleeping bag of claim 1, wherein each of the valve means comprises a mounting flange secured to an exterior surface of the exterior cover; a hollow projection extending from the mounting flange and positioned into fluid communication with an individual one of the air tubes.

3. The adjustable air mattress sleeping bag of claim 2, wherein the hollow projection includes exterior threads; and further comprising a removable cap threadably engaged to the exterior threads of the hollow projection; and a tether coupled to the mounting flange and extending outwardly therefrom to rotatably couple with the removable cap.

* * * * *